US008641586B2

(12) United States Patent
Bremer et al.

(10) Patent No.: US 8,641,586 B2
(45) Date of Patent: Feb. 4, 2014

(54) PERSONAL STRETCHING DEVICE

(75) Inventors: Jon Bremer, Kansas City, MO (US); Caleob Tomas King, Quenemo, KS (US)

(73) Assignee: Jon Bremer, Kansas City, MO (US)

( * ) Notice: Subject to any disclaimer, the term of this patent is extended or adjusted under 35 U.S.C. 154(b) by 134 days.

(21) Appl. No.: 13/428,401

(22) Filed: Mar. 23, 2012

(65) Prior Publication Data

US 2012/0245004 A1 Sep. 27, 2012

Related U.S. Application Data

(60) Provisional application No. 61/467,684, filed on Mar. 25, 2011.

(51) Int. Cl.
*A63B 21/04* (2006.01)

(52) U.S. Cl.
USPC ..... 482/129; 482/121; 482/126; 482/907

(58) Field of Classification Search
USPC ..... 482/121–130, 907; 434/247
See application file for complete search history.

(56) References Cited

U.S. PATENT DOCUMENTS

| | | | | |
|---|---|---|---|---|
| 6,120,423 | A * | 9/2000 | Mackey et al. | 482/121 |
| 6,770,014 | B2 * | 8/2004 | Amore | 482/92 |
| 7,608,016 | B2 * | 10/2009 | Beyzavi-Armani et al. | 482/8 |
| 7,942,793 | B2 * | 5/2011 | Mills et al. | 482/130 |
| 7,955,239 | B2 * | 6/2011 | Wojtkiw et al. | 482/129 |

* cited by examiner

*Primary Examiner* — Glenn Richman
(74) *Attorney, Agent, or Firm* — Hovey Williams LLP

(57) ABSTRACT

A personal stretching device is used to move a user's torso toward a distal structure. The personal stretching device includes an elongated tensile member, a shiftable uptake, and a manually-powered drive mechanism. The shiftable uptake is attached to the elongated tensile member at a proximal location, with the uptake operable to move along the elongated tensile member to change an adjustable length dimension defined between the proximal location and the distal structure. The manually-powered drive mechanism is operable to drive the uptake and thereby move the uptake along the tensile member. The drive mechanism includes a driven element attached to the uptake and a pair of drive elements shiftably mounted relative to the uptake. Each of the drive elements is drivingly coupled to the driven element independent of the other of the drive elements so that the user can drive the uptake by powering either one of the drive elements and thereby change the adjustable length dimension.

21 Claims, 11 Drawing Sheets

PERSONAL STRETCHING DEVICE

RELATED APPLICATION

This application claims the benefit of U.S. Provisional Application Ser. No. 61/467,684, filed Mar. 25, 2011, entitled FLEXIBILITY APPARATUS AND METHODS FOR USE, which is hereby incorporated in its entirety by reference herein.

BACKGROUND

1. Field

The present invention relates generally to equipment used by a person to perform stretching exercises. More specifically, embodiments of the present invention concern a manually-powered device to assist with performing a stretching exercise.

2. Discussion of Prior Art

Personal exercise equipment is often used in settings outside of a gymnasium (e.g., for home use). Conventional exercise equipment is used for a range of exercises such as cardiovascular, weight training, and flexibility exercises.

While such equipment is common, it is also known that many people suffer from back pain and discomfort due to problems with the spine and associated problems. For instance, it has been found that proper stretching of the hamstring muscles tends to reduce some incidences of back pain. However, it has also been found that many people do not understand how to properly stretch the hamstring muscles. Even if a person understands how to correctly stretch the hamstring, the person may have trouble executing the stretch fully and/or safely.

SUMMARY

The following brief summary is provided to indicate the nature of the subject matter disclosed herein. While certain aspects of the present invention are described below, the summary is not intended to limit the scope of the present invention.

Embodiments of the present invention provide a personal stretching device that does not suffer from the problems and limitations of the prior art exercise equipment and methods set forth above.

A first aspect of the present invention concerns a personal stretching device to move a user's torso toward a distal structure. The personal stretching device broadly includes an elongated tensile member, a shiftable uptake, and a manually-powered drive mechanism. The elongated tensile member is operable to be attached to the distal structure. The shiftable uptake is attached to the elongated tensile member at a proximal location, with the uptake operable to move along the elongated tensile member to change an adjustable length dimension defined between the proximal location and the distal structure. The manually-powered drive mechanism operable to drive the uptake and thereby move the uptake along the tensile member. The drive mechanism includes a driven element attached to the uptake drive and a pair of drive elements shiftably mounted relative to the uptake drive and operable to be shifted by the user relative to each other. Each of the drive elements is drivingly coupled to the driven element independent of the other of the drive elements so that the user can drive the uptake by powering either one of the drive elements and thereby change the adjustable length dimension.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
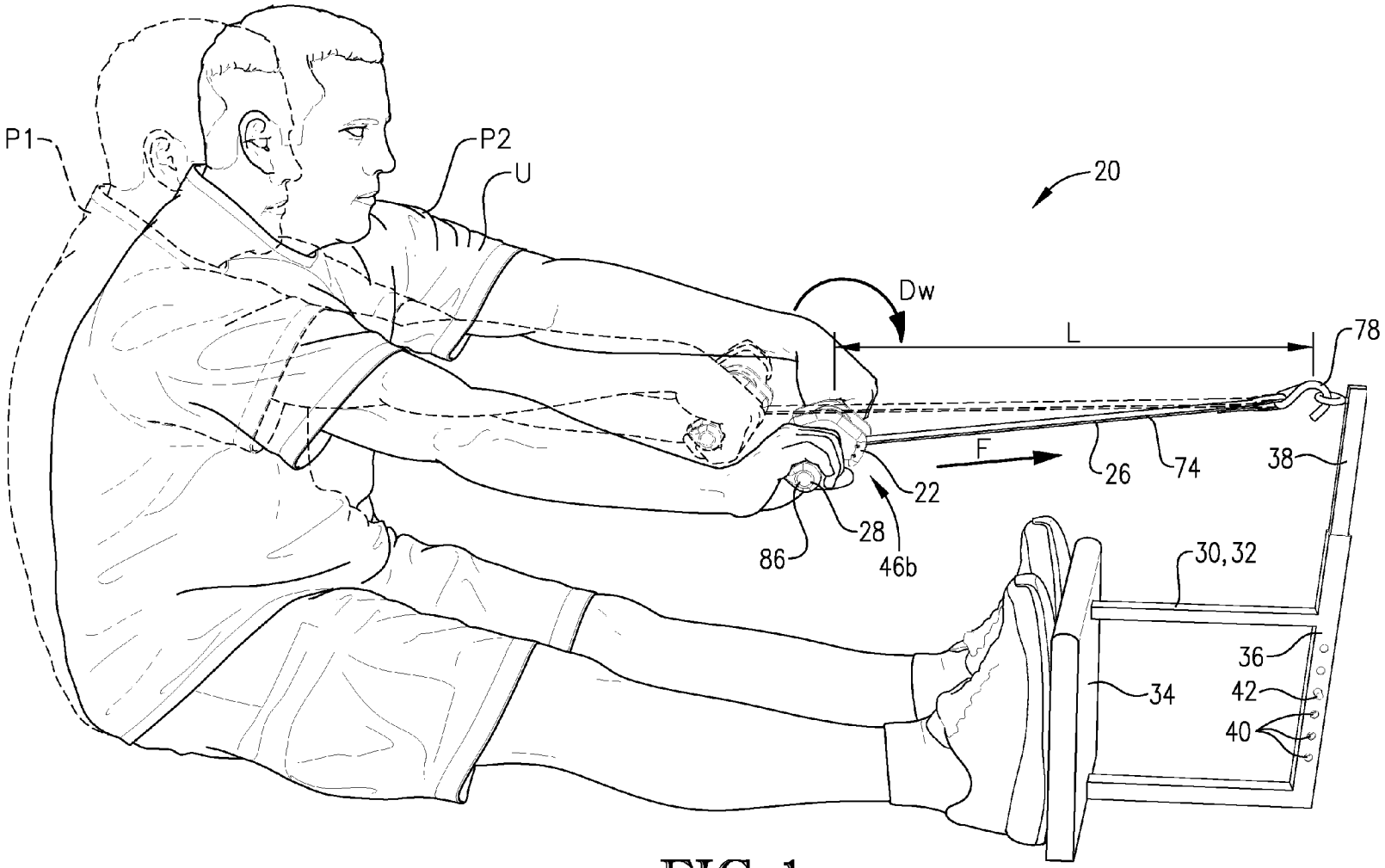
FIG. 1 is a personal stretching device constructed in accordance with a first preferred embodiment of the present invention, with the illustrated device shown as being attached to a support frame and operated by a user in a sitting position, and showing the device shifted between two positions.
Figure 2:
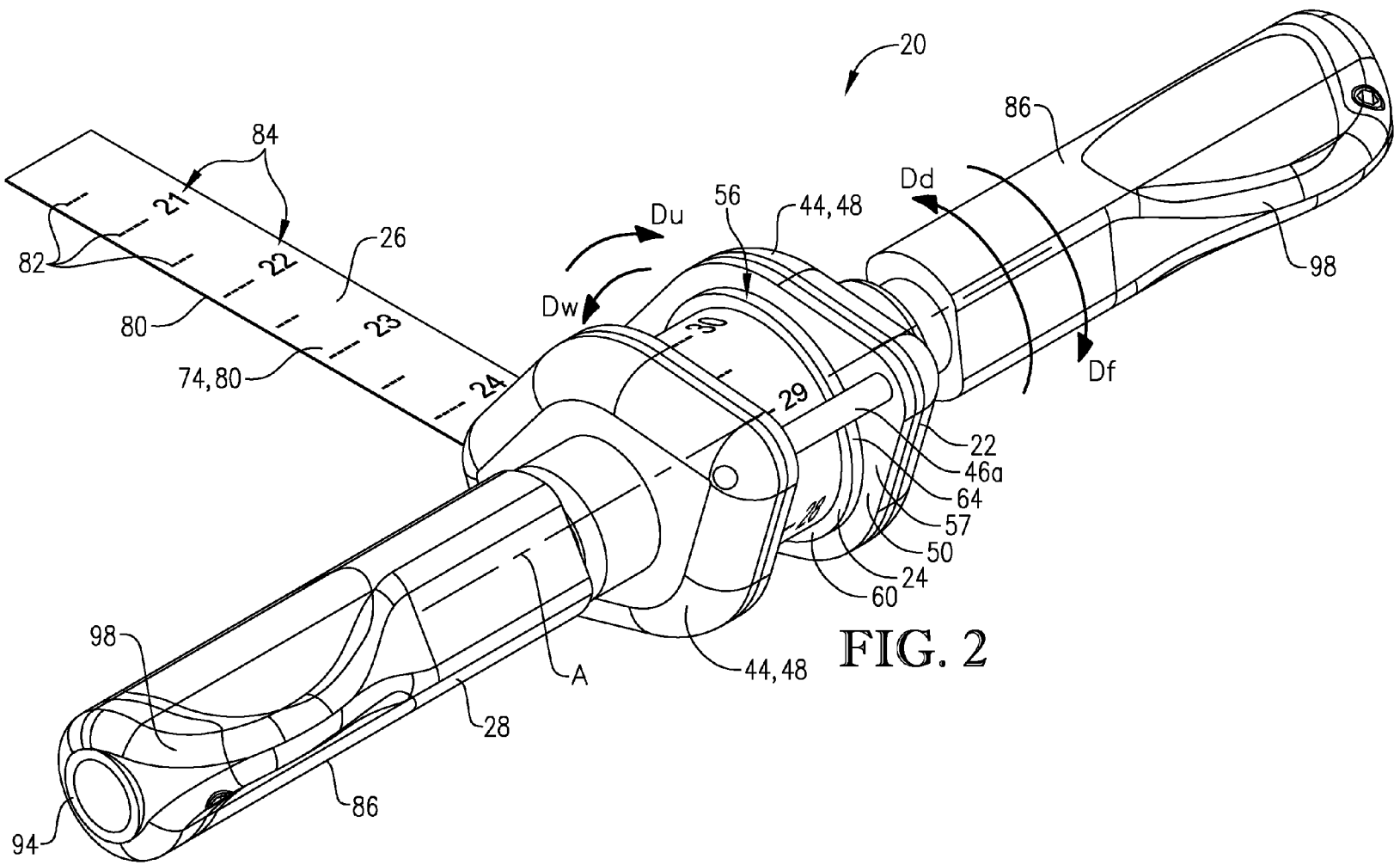
FIG. 2 is a fragmentary rear perspective of the personal stretching device shown in FIG. 1, showing a housing, spool, strap assembly, and a drive assembly.
Figure 3:
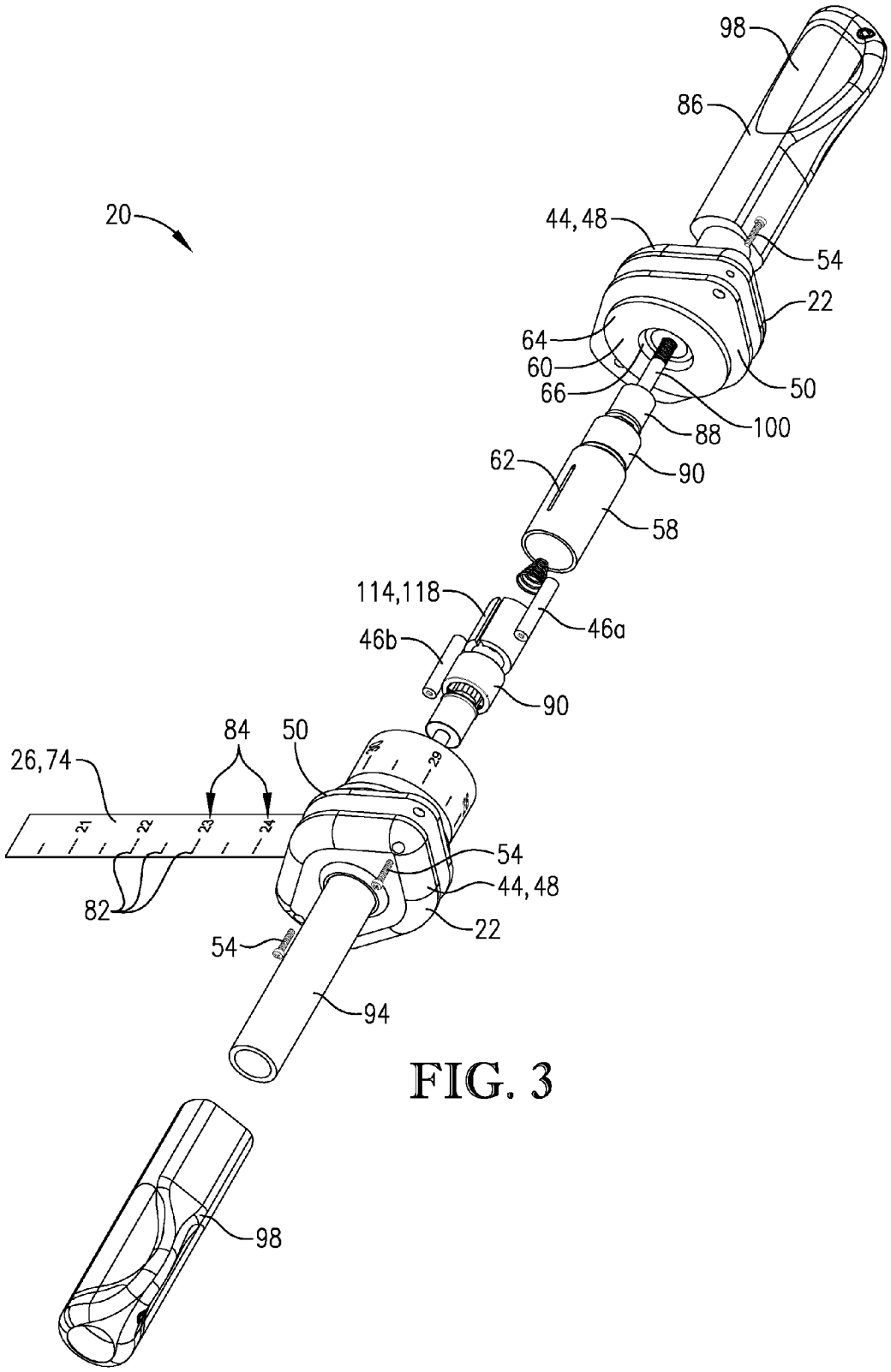
FIG. 3 is an exploded perspective of the personal stretching device shown in FIGS. 1 and 2, showing handles, sockets, clutches, and a bias device of the drive assembly.
Figure 4A:
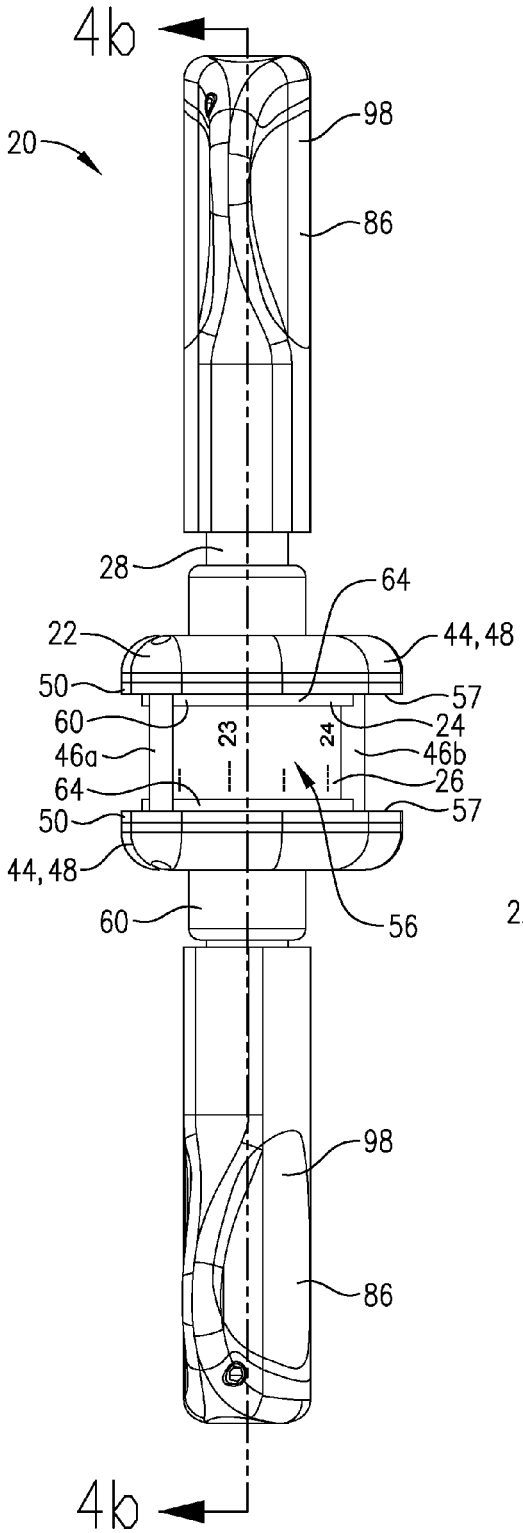
Figure 4B:
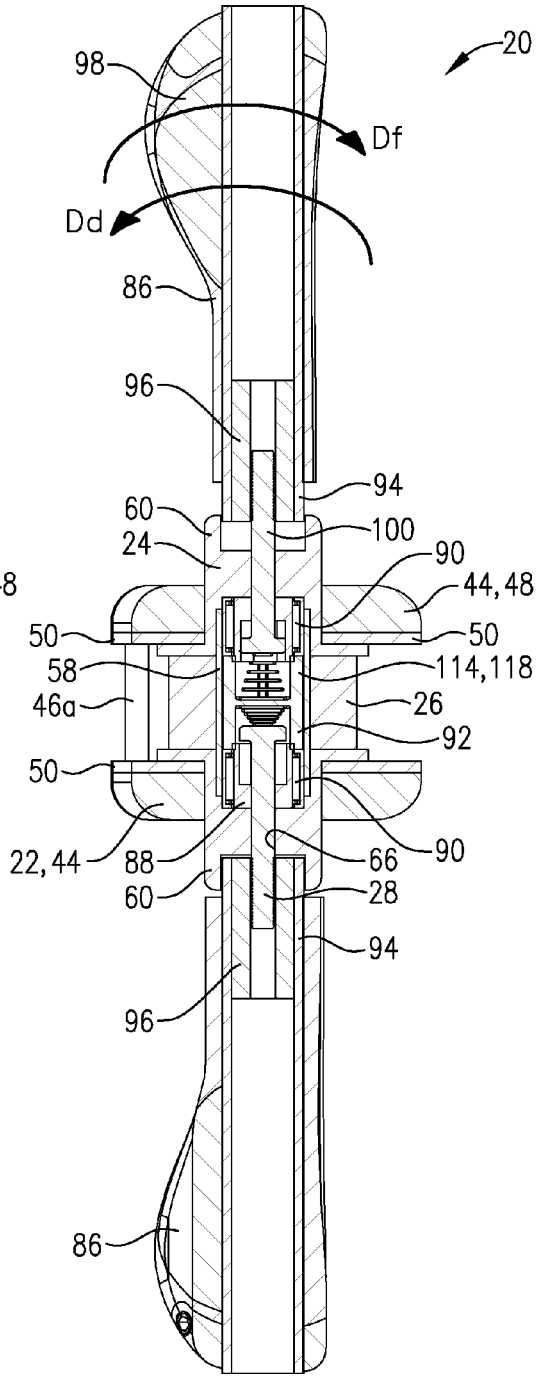
Figure 5:
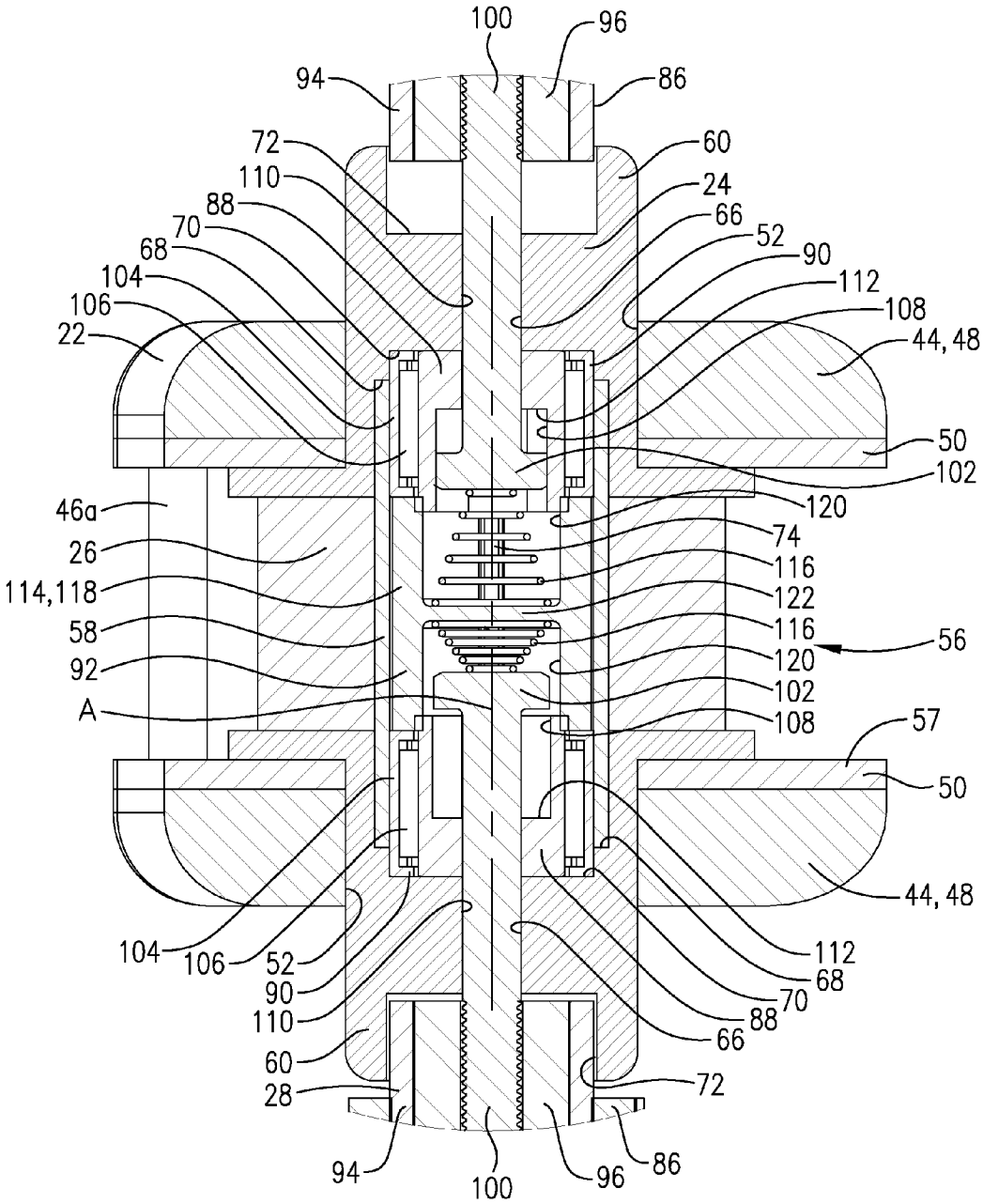

FIG. 4*a* is a rear elevation of the personal stretching device shown in FIGS. 1-3, showing a right handle in an engaged condition and a left handle in a disengaged condition;

FIG. 4*b* is a cross section of the personal stretching device taken along line 4*b*-4*b* in FIG. 4*a*, showing a central spacer and conical springs of the bias device, with an inboard shaft end of the right handle being received in the right socket and an inboard shaft end of the left handle being positioned inboard of the left socket, and showing the strap schematically;

FIG. 5 is an enlarged fragmentary cross section of the personal stretching device shown in FIG. 4*b;*

Figure 6:
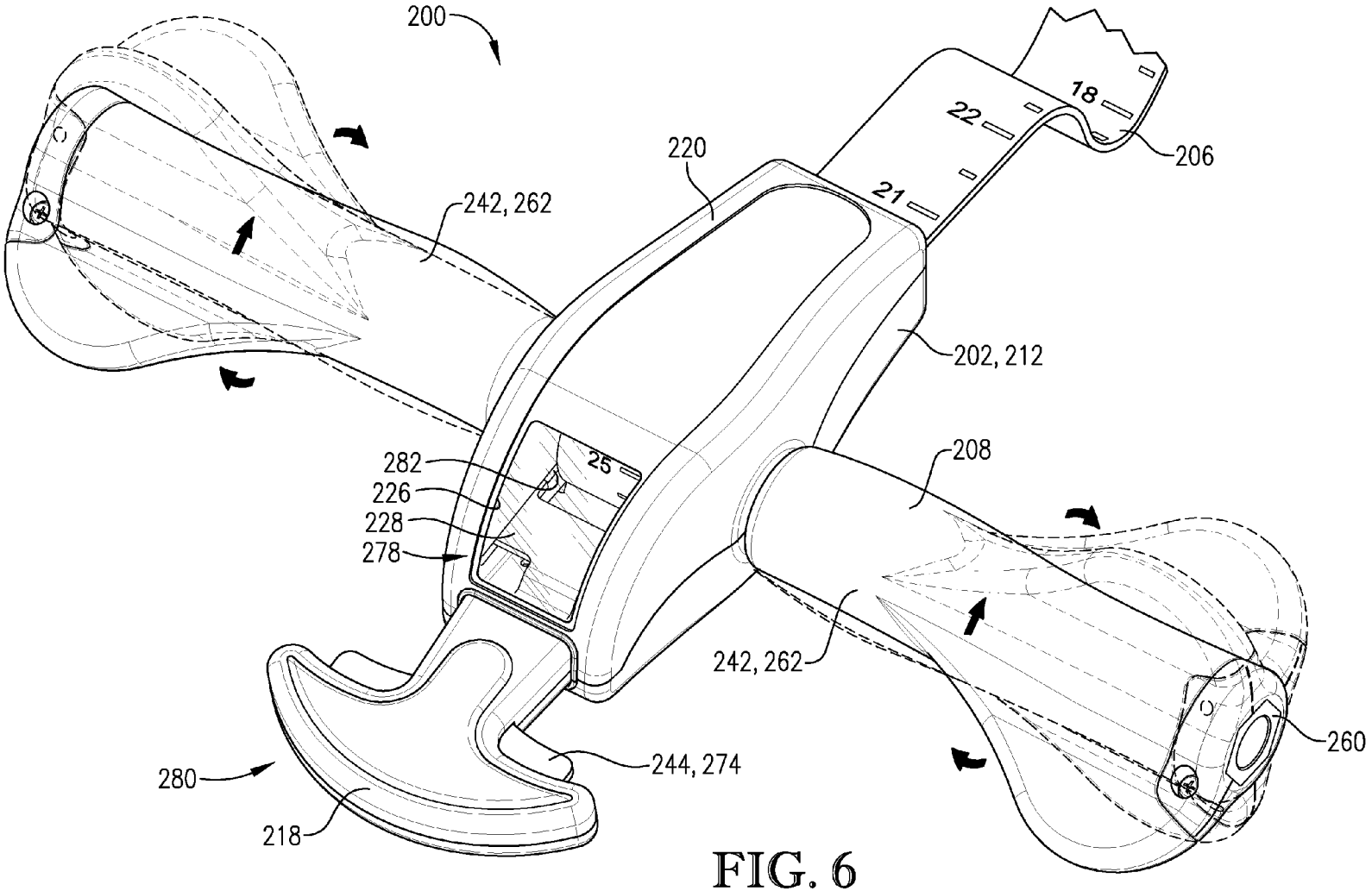
Figure 7:
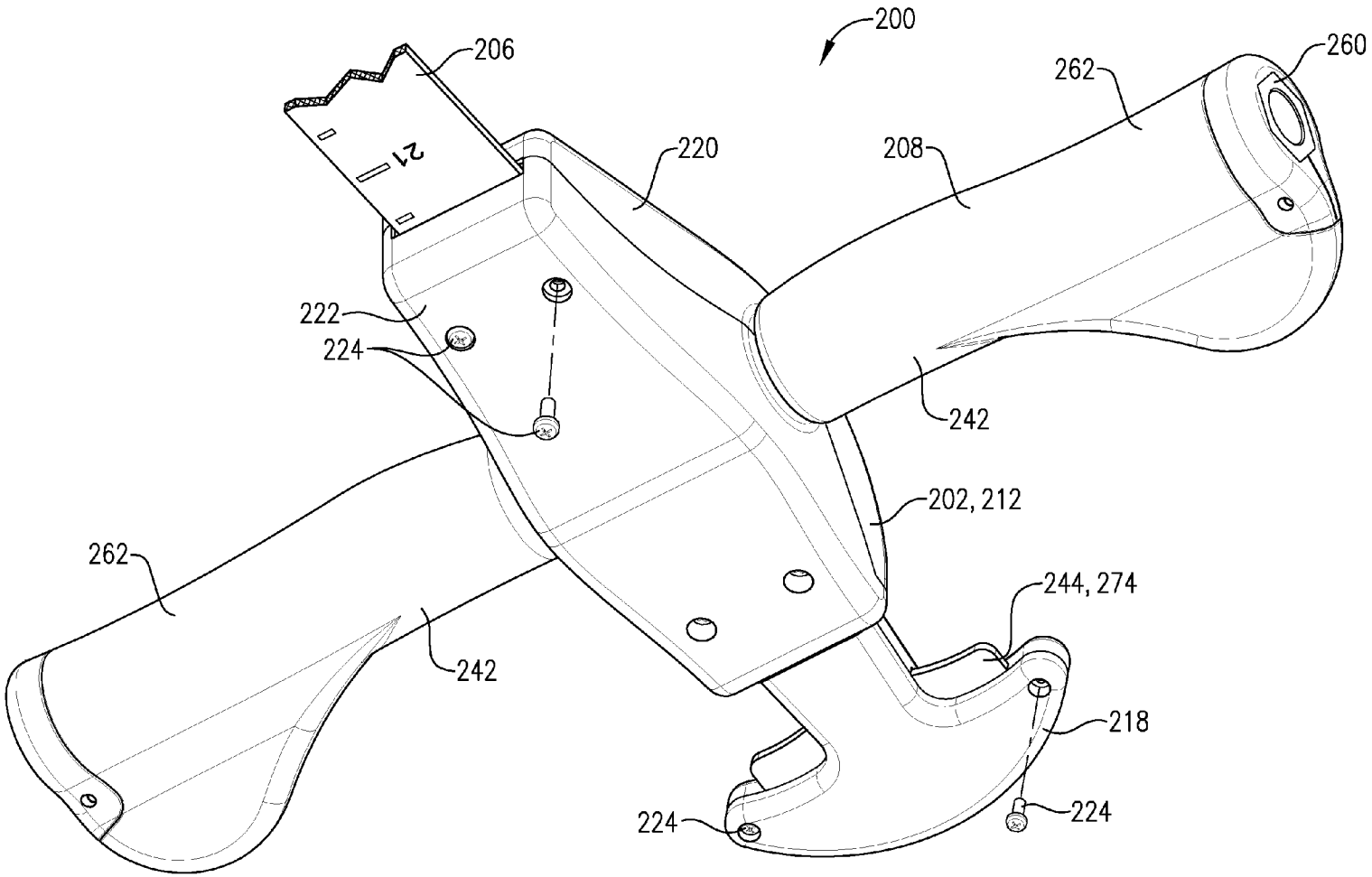
Figure 8:
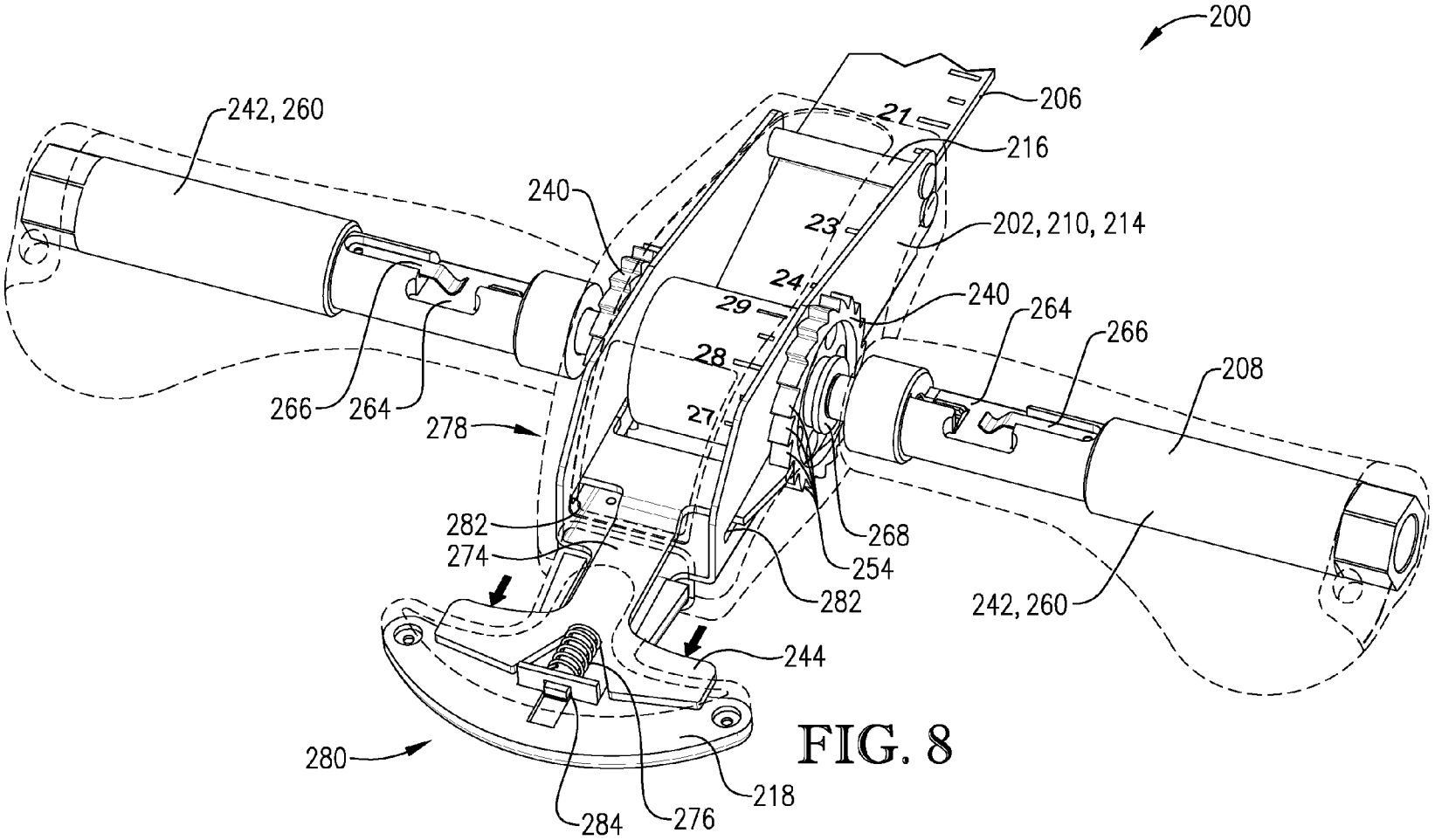
Figure 9:
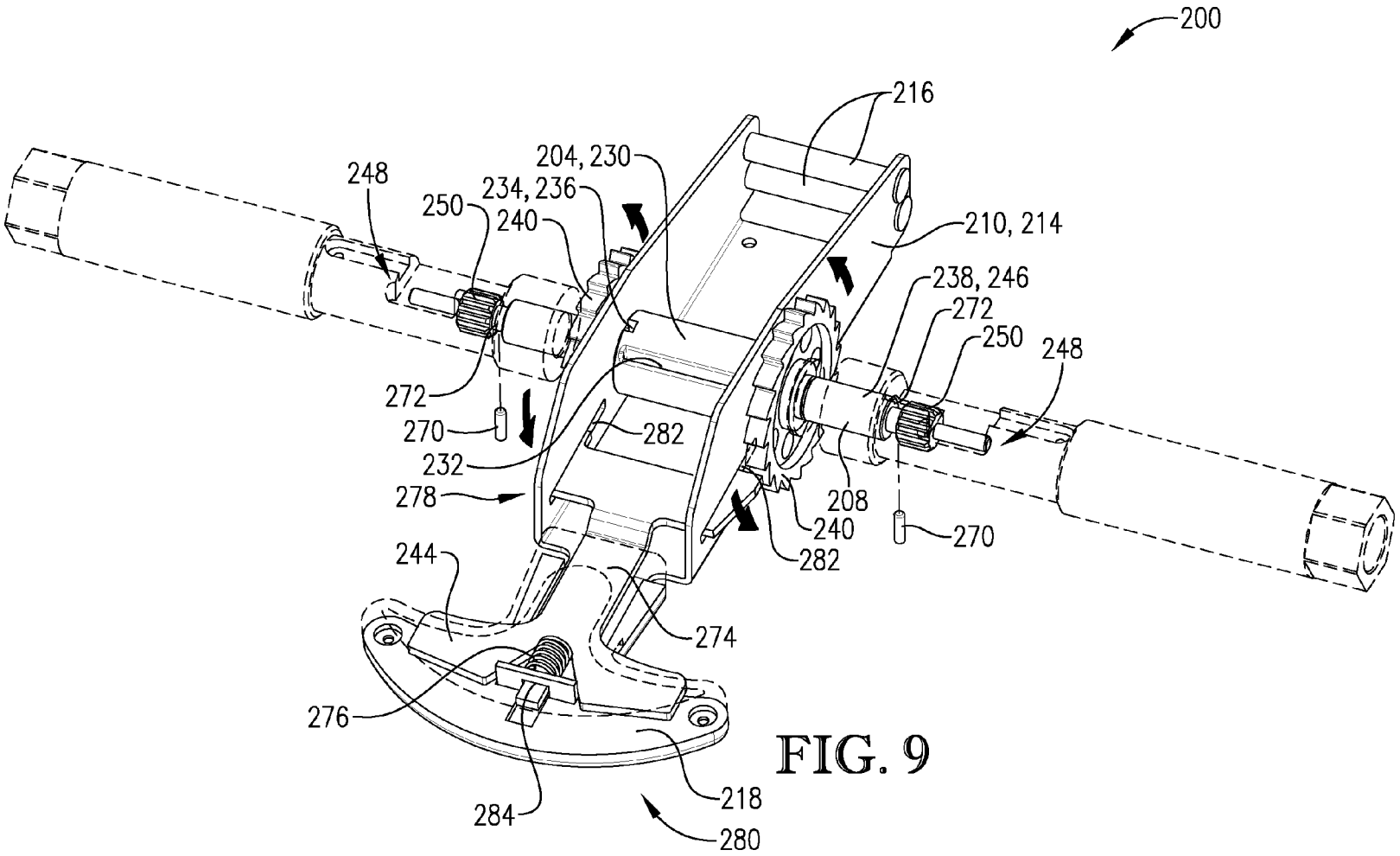
Figure 10:
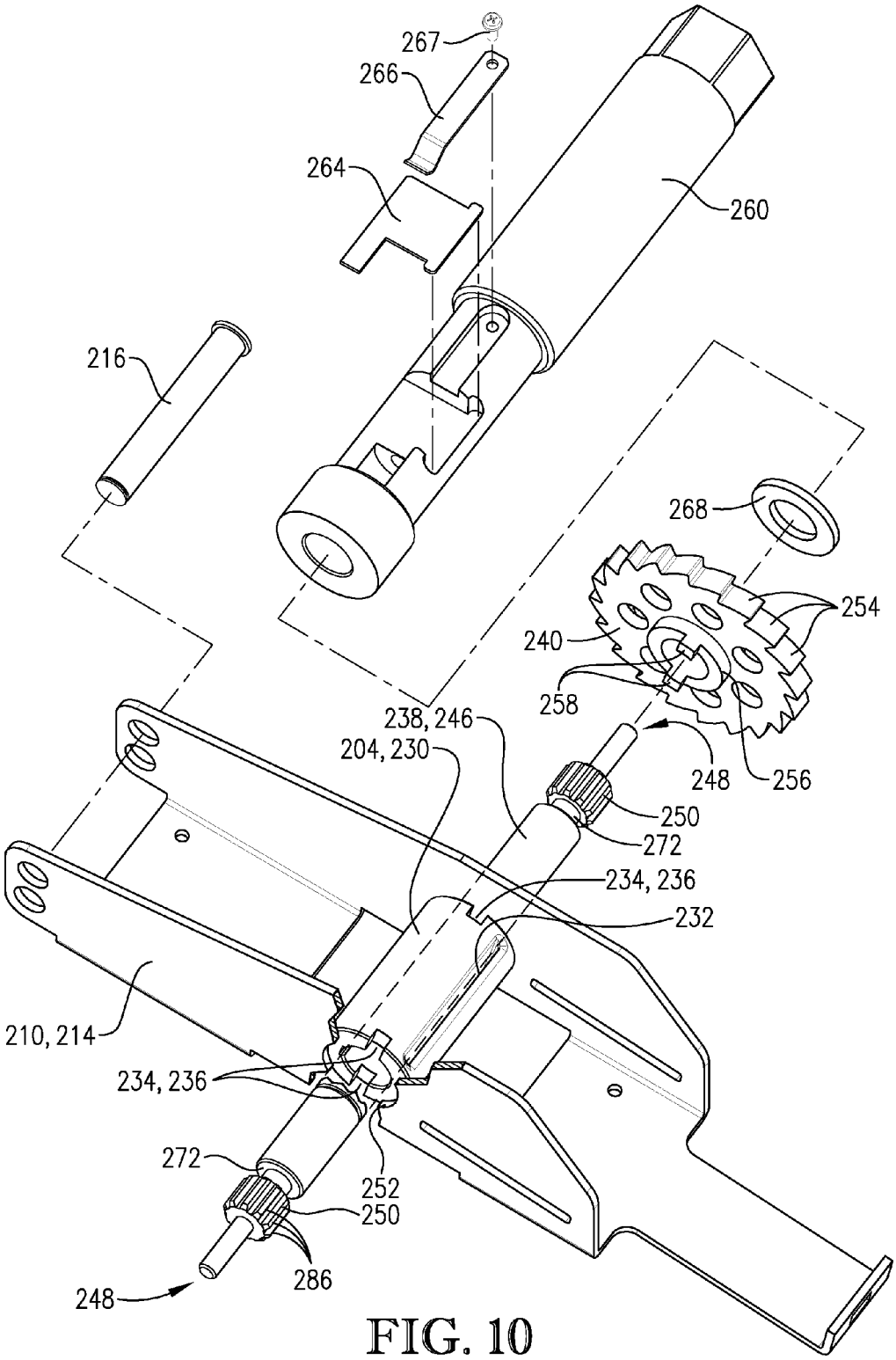
Figures 11, 12:
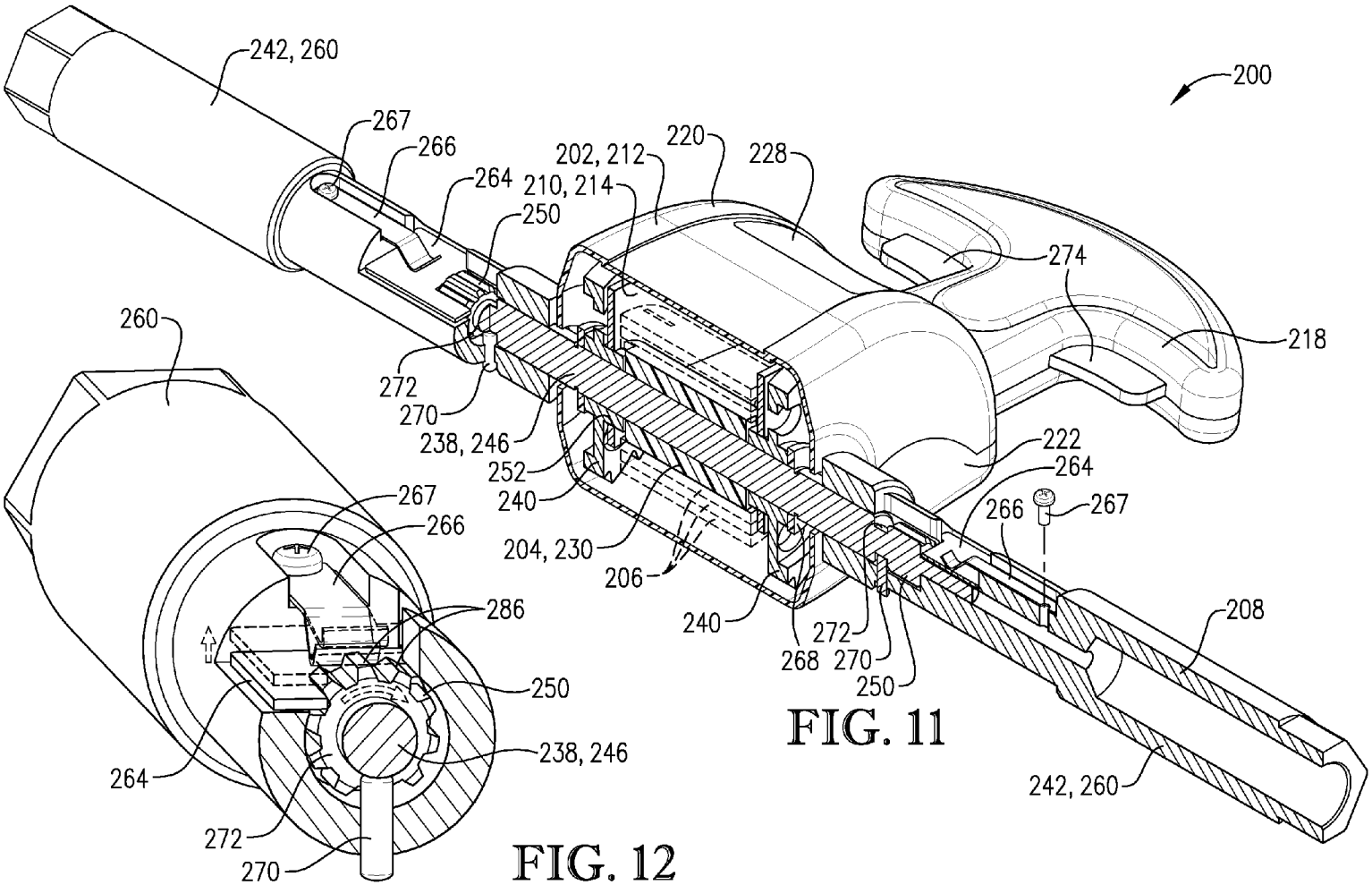

FIG. 6 is an upper rear perspective of a personal stretching device constructed in accordance with a second preferred embodiment of the present invention, with the illustrated device including a housing, spool, strap assembly, and a drive assembly;

FIG. 7 is a lower perspective of the personal stretching device shown in FIG. 6;

FIG. 8 is a fragmentary upper rear perspective of the personal stretching device shown in FIGS. 6 and 7, showing an outer shell of the housing in broken lines to depict the frame of the housing, and the ratchet wheels, axle, and release assembly of the drive assembly, and showing the handles with grips in broken lines to depict the tubular handle body, with a pawl and spring mounted on each handle body;

FIG. 9 is a fragmentary upper rear perspective of the personal stretching device similar to FIG. 8, but showing the strap removed to depict the spool, and a slider of the release assembly shifted proximally so that the ratchet wheels, axle, spool, and handles can be spun in a free direction;

FIG. 10 is a fragmentary exploded perspective of the personal stretching device shown in FIGS. 6-9, showing the axle and spool mounted in the housing frame, with a housing spacer exploded from the remainder of the frame, and with the handle body, washer, and ratchet wheel exploded from the axle, and showing the pawl, spring, and fastener exploded from the handle body;

FIG. 11 is a fragmentary upper perspective of the personal stretching device shown in FIGS. 6-10, with the device being cross sectioned along the laterally extending spool axis to depict components of the housing, strap assembly, and drive assembly; and FIG. 12 is a greatly enlarged fragmentary perspective of the personal stretching device shown in FIGS. 6-11, showing the left handle and axle cross sectioned along a fore-and-aft direction to depict a pin extending through the handle into engagement with a groove presented by the axle, and showing a ratchet gear of the axle in engagement with the pawl of the handle, with the pawl and spring also shown in broken lines to depict teeth of the ratchet gear shifting the pawl and spring in a radially outward direction as the axle rotates relative to the handle.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a personal stretching device 20 is operable by a user U to stretch and improve the flexibility of certain muscles and tissues. Specifically, the device 20 is designed to be grasped and operated by the user U so that the user's arms and torso are pulled by the device 20 in a distal direction, with the user's legs preferably remaining substantially stationary so as to stretch the user's hamstring muscles. Preferably, the personal stretching device 20 broadly includes a housing 22, a spool 24, a strap assembly 26, and a drive assembly 28.

In the illustrated embodiment, the device 20 is used with a mobile support frame 30. The frame 30 provides a location where the device 20 can be attached for operation while the user U is seated. As will be discussed, the device 20 has a strap with a distal hook that is removably attached to the frame 30.

The frame 30 preferably includes a proximal section (not shown) that the user U is seated on during operation. The frame 30 also includes a distal section 32 including a foot rest 34, an upright tube 36, and an adjustable upright post 38 that is telescopically received in the tube 36. The tube 36 presents a plurality of vertically spaced openings 40 that can each be aligned with an opening in the post 38. A pin 42 can be secured through the post opening and one of the tube openings to set the post 38 at a desired height.

However, the principles of the present invention are equally applicable where the frame 30 is alternatively configured for operation of the device 20. For instance, the frame 30 could be constructed so that the device 20 is used in a standing position. Also, for some aspects of the present invention, the device 20 could be attached to a relatively permanent structure, such as a wall or door, during operation.

Turning to FIGS. 2-5, the housing 22 supports other components of device 20 and includes opposite sides 44 and spacers 46 positioned between the sides 44. Each side 44 preferably includes a body 48 and a plate 50 that are attached to one another. Preferably, the body 48 is formed of a synthetic resin material and the plate 50 is formed of a metal, such as brass or aluminum. However, it is within the ambit of the present invention where alternative materials are used to construct the housing sides 44. Each side 44 preferably presents an endless outer margin and a circular opening 52 spaced within the outer margin (see FIG. 5).

The housing 22 preferably includes a single proximal spacer 46*a* and a pair of distal spacers 46*b* located adjacent to one another (see FIGS. 1 and 2). Preferably, the spacers 46 are generally cylindrical and present a threaded bore. The spacers 46 are secured to sides 44 with screws 54 that extend through the side 44 and are threaded into a corresponding spacer 46 (see FIG. 3). When assembled, the circular openings 52 are preferably substantially coaxially aligned.

The illustrated housing 22 preferably presents an open space 56 defined between opposed surfaces 57 presented by the sides 44 (see FIGS. 2 and 4*a*). The housing 22 and spacers 46 define elongated openings along the outer margins of the sides 44. The distal spacers 46*b* are preferably positioned to define an opening therebetween that receives the strap as the strap extends into and out of the housing 22. Furthermore, the distal spacers 46*b* and strap cooperatively orient the housing 22 while the strap is under tension so that the distal spacers are generally located distally from the rest of the housing 22. It is also within the ambit of the present invention where the housing 22 is alternatively constructed. For instance, as will be shown in a subsequent embodiment, the housing 22 could have a relatively enclosed configuration to restrict inadvertent access to the spool 24 and other components adjacent the housing 22, such as the strap 26 and portions of the drive assembly 28.

The illustrated spool 24 is preferably designed to receive a proximal end of the strap assembly 26, with a desired length of the strap being wound onto the spool 24 to provide a desired stretching force F (see FIG. 1). The spool 24 preferably includes a hub 58 and a pair of opposed caps 60 attached to the hub 58. The hub 58 preferably comprises a cylindrical tube that extends between opposite ends of the hub 58. The hub 58 also presents a longitudinally extending slot 62 that is spaced between the ends of the hub 58 (see FIG. 3).

The caps 60 are preferably unitary and substantially identical to one another. Each cap 60 includes opposite ends, with a flange 64 located at one end and an opening 66 that extends axially through the cap 60. The cap 60 also presents inner shoulders 68,70 and outer shoulder 72 (see FIG. 5).

The spool 24 is preferably constructed by attaching each cap 60 onto a respective end of the hub 58 so that each end of the hub 58 engages a respective one of the shoulders 68. The caps 60 and hub 58 are preferably secured to move with one another. However, it is within the ambit of the present invention where the spool 24 is alternatively configured to provide a strap uptake mechanism. For instance, the spool 24 could have an alternatively shaped hub 58 and/or cap 60.

The spool 24 is rotatably mounted in the housing 22 to spin in opposite directions, with the caps 60 located within respective openings 52 so that the flanges 64 are adjacent to surfaces 57. In this manner, the spool 24 is operable to be spun relative to the housing 22 about a spool axis A in either a winding direction Dw or an unwinding direction Du (see FIGS. 2 and 5).

The strap assembly 26 preferably includes an elongated flexible nylon fabric strap 74, an anchor 76, and a hook 78 (see FIGS. 1 and 5). The anchor 76 is preferably a cylindrical pin-shaped metal clamp that is formed onto a proximal end of the strap 74. The anchor 76 serves to attach the proximal end of the strap 74 to the spool 24 by inserting the proximal end through the slot 62 and then securing the anchor 76 to the strap 74. The anchor 76 presents a larger width dimension than the slot 62 so that the anchor 76 restricts the proximal strap end from passing through the slot 62. In this manner, the anchor 76 serves to hold the strap 74 on the spool 24 as the strap 74 is being wound onto (or off of) the spool 24. One of ordinary skill in the art will appreciate that other means could be employed to secure the proximal strap end to the spool 24 without departing from the scope of the present invention.

The illustrated hook 78 is preferably a conventional metal hook that is attached to a distal end of the strap 74 by forming the distal end into a loop. However, it is within the scope of the present invention where an alternative to the hook 78 is employed to secure the distal strap end to a structure for operating the device 20.

The strap 74 is elongated and presents opposite faces 80 that each carry length marking indicia 82 and associated length numbering indicia 84 (see FIG. 2). As will be appreciated, the indicia 82,84 serve to identify a number associated with an adjustable length dimension L measured between the distal strap end and the spool 24. The strap 74 preferably comprises a nylon fabric strap, Model No. 87975K65, supplied by McMaster-Carr. Also, the strap 74 preferably has a maximum tensile strength that ranges from about one hundred (100) pounds to about five hundred (500) pounds and, more preferably, is about two hundred fifty (250) pounds.

Again, the strap 74 is preferably constructed from a nylon fabric material so that the strap 74 can serve as a tensile member. However, the strap fabric could be made of other materials, such as other synthetic resin fibers or metal fibers. Furthermore, it is within the ambit of the present invention where an alternative tensile member construction is employed, such as a chain, a rope or cord, or a generally unitary tensile member, such as a wire.

As discussed above, the strap 74 is preferably wound onto the spool 24 by rotating the spool 24 in the winding direction Dw to generate the stretching force F. For instance, as the user U operates the device 20 to decrease the adjustable length dimension L (i.e., by winding the strap 74 onto the spool 24), the device 20 and the user U are shifted from a first stretching position P1 to a second stretching position P2 (see FIG. 1). With the user U in the illustrated sitting positions P1 ,P2, the force F is generally inversely related to the adjustable length dimension L that is defined between the attachment location and the spool 24 (see FIG. 1). That is, the force F increases as the device 20 and user U move from position P1 to position P2. Again, the strap 74 is preferably fed through the opening defined between distal spacers 46*b*. In this manner, the distal spacers 46*b* and strap cooperatively orient the housing 22 while the strap is under tension so that the distal spacers 46*b* are generally positioned distally from the rest of the housing 22.

It is also within the scope of the present invention where an alternative tensile member and uptake combination is employed to provide the adjustable length dimension L. For instance, a chain and sprocket mechanism could be used where the chain is the tensile member and the sprocket can be rotated to change the adjustable length dimension L.

The drive assembly 28 rotates the spool 24 to change the length dimension L and to thereby change the force F. As will be described in greater detail, the drive assembly 28 is preferably operable to transmit power from the handles to the spool 24 so as to wind the strap 74 onto the spool 24. Furthermore, the drive assembly 28 also has a release mechanism that permits the strap 74 to be quickly unwound from the spool 24.

The illustrated drive assembly 28 preferably includes handles 86, sockets 88, clutches 90, and a bias device 92 (see FIGS. 4 and 5). Preferably, the handles 86 have a similar construction, with each handle 86 including a tubular body 94 and a bushing 96 mounted in an inboard tube end of the body 94. The handle 86 also preferably includes a contoured grip 98 mounted on the tubular body 94. Furthermore, the handle 86 preferably includes a shaft 100 mounted in the bushing 96 and projecting in an inboard direction from the bushing 96 to present an inboard shaft end 102 (see FIG. 5).

The shaft end 102 preferably presents a noncircular cross-sectional shape and, more preferably, presents a generally hexagonal cross-sectional shape. Furthermore, the illustrated shaft 100 is preferably constructed with the remainder of the shaft being cylindrical and generally having a smaller diameter dimension than the maximum diameter of the shaft end 102. Preferably, the handle components are attached to one another so that the handle 86 operates as a unitary structure.

Each handle 86 is preferably mounted in a corresponding one of the caps 60, with the shaft 100 being rotatably mounted in the corresponding opening 66. Additionally, the handle 86 is also preferably slidable relative to the cap 60 along the spool axis A between an inboard position and an outboard position (see FIGS. 4*a* and 4*b*). However, the handles 86 could be alternatively constructed and mounted for operation of the device 20 without departing from the scope of the present invention.

Turning to FIGS. 2, 4*a*, 4*b*, and 5, the clutches 90 each preferably serve to transmit torque between one of the handles 86 and the spool 24 when the handle 86 is rotated in a drive direction Dd while permitting the handle 86 to rotate relative to the spool 24 in an opposite free direction Df. In the illustrated embodiment, each clutch 90 preferably comprises a one-way clutch including a radially outer clutch case 104, a plurality of rollers 106 mounted within the case 104, and a radially inner cage (not shown) mounted within the clutch case 104. As will be appreciated, when the shaft 100 of the handle 86 is rotated in the drive direction Dd, the shaft 100 urges the rollers 106 into a locked position within the cage so that the case 104 is rotated with the shaft 100. When the shaft 100 of the handle 86 is rotated in the free direction Df, the shaft 100 urges the rollers 106 into a free position where the rollers 106 are free to rotate within the cage so that the shaft 100 can rotate relative to the case 104. The illustrated clutch 90 is preferably a One-Way Locking Steel Needle-Roller Bearing, Model No. 2489K5, supplied by McMaster-Carr. Also, the clutch 90 preferably transmits a maximum torque that ranges from about five (5) foot-pounds to about twenty (20) foot-pounds and, more preferably, is about twelve (12) foot-pounds. However, the principles of the present invention are applicable where another mechanism is used to provide one-way torque transmission between the handle 86 and the spool 24. For instance, as will be shown in a subsequent embodiment, a ratcheting device could be used in place of the clutch 90 to provide similar one-way torque operation.

Each clutch 90 is preferably mounted in a corresponding one of the caps 60, with the clutch 90 also being received by a corresponding one of the ends of the hub 58. Thus, the outer clutch case 104 is preferably secured to rotate with the hub 58 and caps 60. The clutches 90 and the rest of the drive assembly 28 are preferably configured so that the drive direction Dd corresponds with the winding direction Dw and the free direction Df corresponds with the unwinding direction Du. However, it is also within the ambit of the present invention where drive direction Dd is opposite to winding direction Dw and free direction Df is opposite to the unwinding direction Du.

Although the illustrated clutches 90 are preferably mounted in caps 60, for some aspects of the present invention the clutches 90 could be alternatively incorporated into the device 20. For instance, the drive assembly 28 could be constructed so that each clutch 90 is incorporated into a respective handle 86, e.g., with a driven element attached to the outer clutch case 104 and extending from the handle into driving attachment with the spool 24.

The sockets 88 each comprise a unitary and generally cylindrical construction. Each socket 88 presents inboard and outboard openings 108,110 that extend between the ends of the socket. The socket 88 also presents a shoulder 112 located between the socket openings 108,110. The inboard opening 108 is preferably a noncircular opening to receive the inboard end of the shaft 100. More preferably, the inboard opening 108 presents a hexagonal cross-sectional shape that substantially conforms to the shape of the inboard end 102 of the shaft 100. However, it is also within the scope of the present invention where the inboard opening 108 has an alternative noncircular shape to permit driving engagement with the shaft 100. The outboard opening 110 is preferably a cylindrical opening operable to rotatably receive the shaft 100. The socket 88 is preferably rotatably received in a corresponding one of the clutches 90, with an outer cylindrical surface of the socket 88 in engagement with the rollers 106.

The shaft 100 preferably extends through the openings 108,110 of the respective socket 88 so that the shaft 100 can slide within the socket 88 between an engaged condition and a released condition. In the engaged condition, the inboard shaft end 102 is positioned in the noncircular inboard opening 108, with the noncircular outer surface substantially conforming to the shape of the inboard opening 108 so that the shaft 100 and socket 88 generally rotate with one another. In the released condition, the inboard shaft end 102 is spaced in the inboard direction from the noncircular inboard opening 108 of the socket 88 so that the spool 24 can be spun freely relative to the handle 86.

With both handles 86 in the engaged condition, each handle 86 of the device 20 can be operated to spin the spool 24 in the winding direction Dw and thereby wind the strap 74 onto the spool 24. In particular, turning at least one of the handles 86 in the drive direction Dd causes corresponding rotation of the socket 88 and the clutch 90 in the drive direction Dd, which also causes rotation of spool 24 in winding direction Dw.

When one of the handles 86 (e.g., the left handle) is rotated in the free direction Df, the clutch 90 permits the left handle 86 to spin freely relative to the spool 24 so that substantially no torque is transmitted to the spool 24 by the one handle 86. Notably, the handle 86 opposite the one handle 86 (e.g., the right handle) is operable to be spun in the drive direction Dd to transmit torque to the spool 24 while the left handle 86 is spun in the free direction Df, and vice versa.

Operation of the handles 86 in the drive and free directions Dd,Df permits the user U to continuously grasp the handles 86 during operation. Generally, when grasping one of the handles, the user's wrist allows a limited range of rotation by the hand. In particular, the wrist allows dorsiflexion of the hand into an upward tilt position. Also, the wrist allows palmar flexion of the hand into a downward tilt position.

Thus, to efficiently wind the strap 74 onto the spool 24 using wrist movement, the handles 86 are preferably alternately rotated in the drive direction Dd to apply torque to the spool 24 and rotate the spool 24 in the winding direction Dw. In other words, as left handle is rotated in the free direction Df, the right handle is rotated in the drive direction Dd, preferably until the wrists do not permit further movement in those directions. As that time, wrist rotation can be reversed so that, as the left handle is rotated in the drive direction Dd, the right handle is rotated in the free direction Df. In this manner, even though the user U can rotate his or her wrists through a limited angle of rotation when grasping the handles 86, the user U can still maintain a constant grip on both handles 86 to operate the device 20.

Thus, in a first operating step, the user U rotates the one handle 86 (e.g., the left handle) in the drive direction Dd by moving the left hand toward the downward tilt position to rotate the spool 24 in the winding direction Dw. Also during this step, the user U rotates the other handle 86 (e.g., the right handle) in the free direction Df by moving the right hand toward the upward tilt position. In a second operating step, the user U rotates the right handle 86 in the drive direction Dd by moving the right hand toward downward tilt position to continue rotation of the spool 24 in the winding direction Dw. Also during this second operating step, the user U rotates the left handle in the free direction Df by moving the left hand toward position upward tilt position. Further operation of the device 20 is preferably continued by repeating these steps in sequence.

While such an alternating sequence of handle rotations is preferred, the spool 24 can be powered in the winding direction Dw by alternative movements. For instance, the spool 24 can be moved in winding direction Dw by simultaneously rotating both handles 86 in the drive direction Dd.

It will be seen in the illustrated embodiment that powering of the handles 86 in the drive direction Dd is performed by palmar flexion of the user's hands. However, it will be appreciated that the device 20 could be inverted during operation so that rotation of the handles 86 in the drive direction Dd is provided by dorsiflexion of the user's hands.

With both handles 86 in the released condition, the inboard shaft ends 102 are drivingly disengaged from the corresponding sockets 88. Consequently, the spool 24 is free to spin in the unwinding direction Du relative to the housing 22, which permits the strap 74 to be unwound from the spool 24.

The drive assembly 28 also preferably includes the bias device 92, which urges the handles 86 into the engaged condition. The bias device 92 includes a generally cylindrical spacer 114 and conical springs 116. The spacer 114 is preferably unitary and includes a tube 118 that extends axially and presents opposite spacer openings 120. The spacer 114 also includes a central wall 122 that extends between the openings 120. The springs 116 each preferably comprise a Confined-Space Conical Compression Spring, Model No. 1692K22, supplied by McMaster-Carr. Also, each spring preferably has a spring rate that ranges between about one (1) pound/inch and about ten (10) pounds/inch and, more preferably, is about seven (7) pounds/inch.

The spacer 114 is positioned within the hub 58 and between the clutches 90 so that the openings 120 are generally axially aligned with the shafts 100. Each opening 120 receives a corresponding spring 116, with the larger end of each spring being positioned against the central wall 122. Thus, the smaller ends of the springs 116 engage corresponding shaft ends 102. In this manner, the springs 116 urge the shafts 100 into the engaged condition and permit shifting of the shafts 100 into the disengaged condition. While the illustrated bias device 92 is preferred, the principles of the present invention are equally applicable where another mechanism is employed to urge the handles 86 into the engaged condition. Furthermore, for some aspects of the present invention, the device 20 could be devoid of the bias device 92.

In operation, the distal end of the strap 74 is initially attached to the post 38 of the frame 30. Preferably, the strap 74 is initially unwound from the spool 24. However, it is also within the scope of the present invention where the strap 74 is partly wound onto the spool 24 prior to operation. With the user U in a seated position on the frame 30, the user U initiates stretching by first winding the strap 74 onto the spool 24 to take up slack in the strap 74. Such winding takes place by first positioning the handles 86 in the engaged condition. With the handles 86 engaged, the user U preferably alternately rotates the handles 86 in the drive direction Dd to cause spool rotation in the winding direction Dw.

With slack taken up in the strap 74, the user U can continue to rotate the spool 24 in the winding direction Dw to effect stretching. The user U can selectively control the device 20 to maintain or increase the stretching force F. Once the user U is ready to remove the stretching force F provided by device 20, the handles 86 can be shifted into the released condition so that the strap 74 can be freely unwound from the spool 24.

Turning to FIGS. 6-12, an alternative stretching device 200 is constructed in accordance with a second embodiment of the present invention. For the sake of brevity, the remaining description will focus primarily on the differences of this alternative embodiment from the preferred embodiment described above. The device 200 broadly includes a housing 202, a spool 204, a strap assembly 206, and a drive assembly 208.

The housing 202 includes a frame 210 and an outer shell 212. The frame 210 is elongated and includes a formed sheet metal body 214, spacers 216 attached to a distal end of the body 214, and a proximal grip cover 218 attached to a proximal end of the body 214. The shell 212 includes upper and lower sections 220,222 that are elongated and attached to one another with fasteners 224. The proximal grip cover 218 is attached to the sections 220,222, with the cover 218 including sections secured with fasteners 224. Preferably, the shell sections 220,222 are formed of a conventional synthetic resin, e.g., by a molding process, although the shell sections could be made of other materials. The upper section 220 presents an opening 226 that receives a transparent window 228 to permit viewing of the space within the shell 212 (see FIG. 6). The illustrated shell 212 preferably substantially encloses the frame 210 to restrict access to the frame 210 and components adjacent to the frame 210.

Turning to FIGS. 8-10, the illustrated spool 204 is designed to receive a proximal end of the strap assembly 206, with a desired length of the strap being wound onto the spool 204 to provide the desired stretching force F. The spool 204 preferably comprises a tube 230 and presents a longitudinal slot 232 and opposite ends 234. Each of the ends includes radially extending grooves 236. As will be discussed, the spool 204 is mounted for rotation on an axle 238 of the drive assembly 208 and is drivingly engaged by ratchet wheels 240 of the drive assembly 208. The spool 204 is operable to be spun relative to the housing about the spool axis in either the winding direction Dw or the unwinding direction Du (see FIGS. 6 and 8).

The illustrated drive assembly 208 preferably includes the axle 238, the ratchet wheels 240, handles 242, and a release assembly 244. The axle 238 is preferably unitary and includes an elongated shaft 246 that extends between opposite ends 248. The axle 238 includes ratchet gears 250 adjacent each end 248 and formed integrally with the shaft 246. The axle 238 is rotatably mounted within openings 252 in the frame 210 (see FIG. 10). Additionally, the axle 238 extends through the spool 204, with the axle 238 and spool 204 rotating together about the spool axis.

Each ratchet wheel 240 includes a plurality of circumferentially positioned teeth 254 and a central hub 256 with tabs 258 that project axially from the rest of the hub 256 (see FIG. 10). The ratchet wheel 240 is mounted on the axle 238 so as to drivingly engage a respective end of the spool 204, with the tabs 258 being positioned in corresponding grooves 236 so that the ratchet wheels 240 and spool 204 move with one another.

Each of the handles 242 includes an elongated tubular body 260 that extends between inboard and outboard ends and a contoured grip 262 mounted on the tubular body 260. Also, each handle 242 preferably includes a pawl 264 and a spring 266 secured with a fastener 267 to the body 260, with the spring 266 holding the pawl 264 in engagement with the body 260.

The handles 242 are each mounted on corresponding ends 248 of the axle 238, with washers 268 being positioned between the inboard end of the handles 242 and the corresponding ratchet wheels 240 (see FIG. 10). The handles 242 are held on the axle 238 with pins 270 that extend radially through an opening in the handle and into circumferential grooves 272 presented by the axle 238 (see FIGS. 11 and 12).

Turning to FIGS. 8 and 9, the release assembly 244 includes a slider 274 and a spring 276. The slider 274 is preferably unitary and elongated and includes a distal pawl end 278 and a proximal grip end 280. The slider 274 is shiftably mounted on the frame 210, with the pawl end 278 being slidably received by slots 282 in the frame 210, and the grip end 280 is slidably mounted in opening 284. The spring 276 serves to urge the slider 274 distally into a distal-most position. In the distal-most position, the pawl end 278 engages the teeth 254 of ratchet wheel 240 to permit rotation of the wheel 240 and spool 204 in the drive direction Dd while restricting rotation of the wheel 240 and spool 204 in the free direction Df. The release assembly 244 permits wheel rotation in the drive direction Dd because the teeth present cam surfaces that shift the slider 274 proximally against the spring 276 as the wheel 240 rotates in the drive direction Dd.

Turning to FIGS. 11 and 12, the handles 242 and axle 238 cooperatively provide ratchet mechanisms associated with respective handles 242. In particular, with the handle 242 mounted on the axle 238, the pawl 264 is urged into engagement with the corresponding ratchet gear 250. As the handle 242 is rotated in the drive direction Dd, the pawl 264 engages a tooth 286 of the gear 250 so that the axle 238 and handle 242 move with one another in the drive direction Dd, with the spool 204 being driven in the winding direction Dw by the axle 238 (see FIG. 12). As the handle 242 is rotated in the free direction Df, an adjacent tooth 254 of the gear 250 has a cam surface that urges the pawl 264 radially outwardly from the ratchet gear 250 so that handle rotation is permitted relative to the axle 238 (see FIG. 12).

Thus, similar to clutches 90, the ratchet mechanisms each preferably serve to transmit torque between one of the handles 242 and the spool 204 when the handle 242 is rotated in the drive direction Dd while permitting the handle 242 to rotate relative to the spool 204 in the opposite free direction Df.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby states their intent to rely on the Doctrine of Equivalents to determine and assess the reasonably fair scope of the present invention as pertains to any apparatus not materially departing from but outside the literal scope of the invention as set forth in the following claims.

What is claimed is:

1. A personal stretching device to move a user's torso toward a distal structure, said personal stretching device comprising:

an elongated tensile member operable to be attached to the distal structure;

a shiftable uptake attached to the elongated tensile member at a proximal location, with the uptake operable to move along the elongated tensile member to change an adjustable length dimension defined between the proximal location and the distal structure; and a manually-powered drive mechanism operable to drive the uptake and thereby move the uptake along the tensile member, said drive mechanism including a driven element attached to the uptake and a pair of drive elements shiftably mounted relative to the uptake and operable to be shifted by the user relative to each other, each of said drive elements being drivingly coupled to the driven element independent of the other of said drive elements so that the user can drive the uptake by powering either one of the drive elements and thereby change the adjustable length dimension.

2. The personal stretching device as claimed in claim 1, said drive mechanism having an engaged condition where each drive element is shiftable in a drive direction to drivingly engage and shift the driven element and move the uptake and shiftable in an opposite direction without shifting the driven element and moving the uptake.

3. The personal stretching device as claimed in claim 2, at least part of said drive mechanism being shiftable relative to the uptake from the engaged condition to a released condition where the drive elements can be shifted in either direction without moving the uptake.

4. The personal stretching device as claimed in claim 3, said drive mechanism including a bias device that urges the drive mechanism from the released condition to the engaged condition.

5. The personal stretching device as claimed in claim 2, said drive mechanism including another driven element, with each drive element being rotatably mounted in engagement with a respective driven element.

6. The personal stretching device as claimed in claim 5, each engaged pair of drive and driven elements being provided as part of a one-way clutch, with the drive and driven elements being in driving engagement when the drive element is rotated in the drive direction and out of driving engagement when the drive element is rotated in the opposite direction.

7. The personal stretching device as claimed in claim 5, each engaged pair of drive and driven elements being provided as part of a ratchet device, with the drive and driven elements being in driving engagement when the drive element is rotated in the drive direction and out of driving engagement when the drive element is rotated in the opposite direction.

8. The personal stretching device as claimed in claim 2; and a housing, said uptake comprising a spool rotatably mounted on the housing.

9. The personal stretching device as claimed in claim 8, said tensile member being flexible and presenting a proximal end attached to the uptake, with the tensile member operable to be wound onto the uptake to reduce the adjustable length dimension.

10. The personal stretching device as claimed in claim 2, said drive mechanism including another driven element, with each drive element being rotatably mounted in engagement with a respective driven element; and a pair of handles each attached to a respective one of the drive elements so that handle rotation is operable to cause rotation of the respective drive element in the engaged condition.

11. The personal stretching device as claimed in claim 10, each pair of drive and driven elements in the engaged condition being in driving engagement when the drive element is rotated in the drive direction and out of driving engagement when the drive element is rotated in the opposite direction.

12. The personal stretching device as claimed in claim 11, each of said handles being shiftable relative to the respective drive element between the engaged condition where each handle and the respective drive element are drivingly engaged and rotate with each other and a released condition where each handle and the respective drive element are drivingly disengaged so as to be rotatable relative to each other.

13. The personal stretching device as claimed in claim 12, said drive elements each presenting a socket with a noncircular opening, each of said handles presenting a handle end that is slidable relative to the respective drive element between the engaged condition where the handle end is positioned in the noncircular opening and the released condition where the handle end is spaced from the noncircular opening, with the handle end presenting a non-circular outer surface that substantially conforms to the shape of the noncircular opening when the handle end is in the engaged condition.

14. The personal stretching device as claimed in claim 13, said drive mechanism including a bias device that urges each handle and the respective drive element from the released condition to the engaged condition.

15. The personal stretching device as claimed in claim 14, said bias device including a spring that engages at least one of the handles and urges the handles to shift relative to the respective drive elements from the release condition to the engaged condition.

16. The personal stretching device as claimed in claim 1, said drive mechanism including a release assembly with a ratcheting wheel and release pawl, said uptake member being rigidly coupled to the ratcheting wheel, with the release assembly only permitting one-way rotation of the uptake when the pawl is engaged with the ratcheting wheel.

17. The personal stretching device as claimed in claim 16, said drive mechanism including a release member to disengage the pawl from the ratcheting gear to permit the tensile member to be drawn away from the uptake.

18. The personal stretching device as claimed in claim 16, said uptake presenting a maximum lateral cross-sectional diameter dimension that ranges from about 0.1 inches to about 4 inches.

19. The personal stretching device as claimed in claim 1, said drive mechanism including a pair of handles each attached to a respective one of the drive elements so that handle rotation is operable to cause rotation of the respective drive element in the engaged condition, said drive mechanism including a pair of ratcheting gears rigidly coupled to the uptake and a pair of ratcheting pawls attached to a respective handle, with a respective ratcheting gears and pawls being in engagement so that rotation of each handle in a drive direction causes corresponding rotation of the uptake.

20. The personal stretching device as claimed in claim 16, said drive mechanism including an axle extending axially through and rigidly attached to the uptake, with the axle presenting opposite ends spaced from the uptake, said handles being rotatably mounted on respective ends of the axle.

21. The personal stretching device as claimed in claim 1, said tensile member presenting dimension indicia positioned periodically along the length of the tensile member, with the indicia being viewable by the user during operation of the device.

* * * * *